US006129596A

United States Patent [19]

Yamatani

[11] Patent Number: 6,129,596

[45] Date of Patent: Oct. 10, 2000

[54] ELECTRIC CONNECTOR

[75] Inventor: Eiji Yamatani, Saitama, Japan

[73] Assignee: Kansei Corporation, Saitama, Japan

[21] Appl. No.: 09/264,035

[22] Filed: Mar. 8, 1999

[30] Foreign Application Priority Data

| | | | |
|---|---|---|---|
| Mar. 9, 1998 | [JP] | Japan | 10-056868 |
| Sep. 4, 1998 | [JP] | Japan | 10-250798 |
| Dec. 2, 1998 | [JP] | Japan | 10-342945 |

[51] Int. Cl.[7] ..... H01R 13/514; H01R 13/40

[52] U.S. Cl. ..... 439/752; 439/595

[58] Field of Search ..... 439/752, 595, 439/685, 687, 689

[56] References Cited

U.S. PATENT DOCUMENTS

| | | | |
|---|---|---|---|
| 5,292,262 | 3/1994 | Endo et al. | 439/752 |
| 5,769,670 | 6/1998 | Abe | 439/752 |
| 5,860,834 | 1/1999 | Sugiyama | 439/595 |

FOREIGN PATENT DOCUMENTS

| | | | |
|---|---|---|---|
| 5-226025 | 9/1993 | Japan | H01R 13/42 |

*Primary Examiner*—Lincoln Donovan
*Assistant Examiner*—Chandrika Prasad
*Attorney, Agent, or Firm*—Sughrue, Mion, Zinn, Macpeak & Seas, PLLC

[57] ABSTRACT

In an electric connector of a type that connecting terminals (29) inserted into a connector housing (21) are respectively secured double not only by securing lances (23) but also by retainers (24) which can be inserted through their associated retainer insertion holes 28 formed in the connector housing (21), at the preset positions of the retainers (24) that are respectively situated between the front end portions (30) of the retainers (24) formed in the insertion direction of the retainers (24) and the rear end portions (31) thereof, there are formed hook portions (34) which can be respectively secured by the rear edge portions (28B) of the retainer insertion holes (28) that are situated in the opposite direction to the insertion direction of the connecting terminals.

6 Claims, 11 Drawing Sheets

ELECTRIC CONNECTOR

BACKGROUND OF THE INVENTION

1. Field of the Invention

The present invention relates to an electric connector for use in a vehicle such as an automobile and the like and, in particular, to an electric connector which is used to secure double connecting terminals respectively inserted into a connector housing not only by securing lances but also by retainers in such a manner that the secured condition of the connecting terminals by the retainers can be detected easily and positively.

2. Description of the Related Art

As an example of a conventional electric connector of the above type that the connecting terminals inserted into the connector housing are secured double not only by the securing lances but also by the retainers, there is known an electric connector having such a structure as shown in FIG. 1. Referring now to the conventional structure shown in FIG. 1, reference character 1 designates a connector housing. In particular, in the connector housing 1, there are formed a plurality of terminal storage chambers 2 which extend substantially parallel to one another and, in the terminal storage chambers 2, there are provided their associated securing lances 3 in such a manner that the securing lances 3 are formed integrally with the connector housing 1. Also, on the outside portion of the connector housing 1, there are disposed two or more retainers 5 which are connected and held by their associated bands 4 provided from the outside portion of the connector housing 1. These retainers 5, as shown in FIG. 1, are held in their respective preset conditions within their associated retainer insertion holes 6 respectively formed in the wall surfaces of the connector housing 1, in order to prevent the possibility that, when the connector housing 1 is delivered (transported), the retainers 5 can swing loosely or can be cut off from the bands 4. Also, the connector housing 1 is structured such that, after connecting terminals 8 are completely inserted into their respective terminal storage chambers 2, if the preset retainers 5 are inserted into their respective terminal storage chambers 2 deeper than the above-mentioned retainer insertion holes 6, then the insertion front end portions 7 of the retainers 5 are inserted into their respective terminal storage chambers 2 of the connector housing 1 and are thereby secured to the connecting terminals 8.

In particular, the connecting terminals 8 inserted into their respective terminal storage chambers 2 of the connector housing 1 are prevented against removal not only by the securing lances 3 that are disposed within their respective terminal storage chambers 2 of the connector housing 1 but also by the retainers 5 that are inserted into their respective terminal storage chambers 2 through the retainer insertion holes 6. That is, the connecting terminals 8 are prevented by such double securing means from removing from their respective terminal storage chambers 2.

After the insertion operation to insert the connecting terminals 8 into their respective terminal storage chambers 2 is completed, a check connector 10, which has been prepared previously, is fitted with the connector housing 1 to conduct a test as to whether the connecting terminals 8 and wire harnesses 9 connected to their respective connecting terminals 8 are connected together correctly at their proper positions or not. If the test shows that they are connected together correctly at their proper positions, then the connector housing 1 can be delivered to the following step.

As described above, in the above-mentioned electric connector structure, when the retainers 5 are held in their preset conditions (in half fitted conditions), the connecting terminals 8 are respectively inserted into their associated terminal chambers 2 and are thereby secured to their associated securing lances 3. Next, as a second insertion operation, the preset retainers 5 are further inserted into their associated terminal chambers 2 still deeper and the insertion front end portions 7 of the retainers 5 are thereby secured to their associated connecting terminals 8, so that the connecting terminals 8 are secured double by the retainers 5 and securing lances 3. However, for example, assuming a case in which the above-mentioned second insertion operation of the retainers 5 is forgotten, the connecting terminals 8 are prevented against removal only by the securing forces of the securing lances 3 within the terminal storage chambers; that is, the connecting terminals 8 are not secured double but they are held in a connected condition (namely, the condition shown in FIG. 1) in which their securing forces are short.

In spite of the above short securing force condition, if the check connector 10 is fitted with the above connector housing 1, then the check connector 10, as shown in FIG. 2, is able to advance while moving back the retainers 5 by the front end edge thereof and can be completely fitted with the connector housing 1; that is, due to the complete fitting of the check connector 10 with the connector housing 1, connecting terminals 11 provided within the check connector 10 can be connected normally with the connecting terminals 8 singly secured only by the securing lances 3. Therefore, as the result of the connection check, no abnormal condition can be found. In other words, there is a possibility that such singly secured electric connector can be shipped or delivered to the following step as a normal electric connector while the connecting terminals 8 thereof are held in a singly secured condition only by their associated securing lances, that is, the connecting terminals 8 are not secured double by the retainers and securing lances.

Also, as another conventional electric connector, there has been known an electric connector disclosed in Japanese Patent Unexamined Publication No. Hei 5-226025. According to this publication, the electric connector is formed of synthetic resin by injection molding or by similar means and, as shown in FIGS. 3 to 5 a housing 110 and a retainer 120 are formed integrally with each other through a band hinge 130. In the interior portion of the housing 110, there is formed a terminal storage chamber 140; and, in the terminal storage chamber 140, there is provided a flexible securing piece 141 which is used to secure a terminal metal member 150 and also there is formed an opening 142 through which the retainer 120 can be inserted.

In the retainer 120, there are provided a terminal securing projection 121 and a fully securing projection 122, whereas in the terminal securing projection 121, there is provided a provisionally securing projection 123. Before the terminal metal members 150 are inserted, when the electric connectors are moved while they are piled up on top of another in such a manner that the retainers 120 are separated from their respective housings 110 by the band hinges 130, there is a possibility that the electric connectors can be entwined together. In order to avoid such possibility, the electric connectors are moved while they are collected together in such a provisionally connected condition as shown in FIG. 4 in which the retainers 120 are respectively inserted into their associated openings 142 and the provisionally securing projections 123 are respectively secured to the peripheral edges of their associated openings 142 due to the elasticity of the band hinges 130. The provisionally securing projection 123, as shown in FIG. 3, includes two tapered surfaces 123*a* respectively formed in the inserting and removing directions thereof, so that the projection 123 portion of the retainer 120 formed slightly larger than the width of the opening 142 can be made to pass through the opening 142 easily.

To complete the assembly of the provisionally connected electric connector, the terminal metal member 150 may be inserted into the terminal storage chamber 140 to be thereby secured to the flexible securing piece 141 and, next, the retainer 120 may be pushed into the terminal storage chamber 140 so that the terminal securing projection 121 can press against the terminal metal member 150 and the fully securing projection 122 can be secured to the peripheral edge of the opening 142.

However, in the above-mentioned conventional electric connector, because the retainer 120 or the provisionally securing projection 123 thereof is simply secured to the peripheral edge of the opening due to the elasticity of the band hinge 130, there is a case where, in the connectors collecting and moving process, the retainer 120 is pushed further into the terminal storage chamber 140 beyond the provisionally connected condition, and as shown in FIG. 5, the terminal securing projection 121 of the retainer 120 is secured to the peripheral edge of the opening 142 to thereby leave the retainer 120 in an obliquely inserted manner. Due to this, when inserting the terminal metal member 150, the terminal metal member 150 cannot be inserted up to a given position where it can be secured to the flexible securing piece 141. This gives rise to the poor assembly of the terminal metal member 150 and also the number of assembling man-hour increases for correction of the poor assembly.

SUMMARY OF THE INVENTION

The present invention aims at eliminating the drawbacks found in the above conventional electric connectors in which the connecting terminals inserted into the connector housing, respectively, are secured double using not only the securing force by the securing lances but also the securing force by the retainers.

Accordingly, an object of the invention is to provide an electric connector in which, when fitting or engaging a check connector with the connector housing after the connecting terminals are inserted therein, if the securing forces by the retainers are not applied to the connecting terminals, that is, if the retainers remain held in their preset conditions, then the check connector cannot be engaged with the connector housing completely and also the complete engagement prevented condition of the check connector can be detected, so that it is possible to discover an electric connector in which the connecting terminals within the connector housing are not secured double, that is, an electric connector in which the connecting terminals are secured in a defective manner.

Also, another object of the invention is to provide an electric connector in which a terminal metal member can be inserted and assembled positively and easily while a retainer is held in such a provisionally connected condition as to prevent the present electric connector from being entwined with other electric connector(s) even in the connectors collecting and moving process.

In attaining the above object, according to a first aspect of the invention, there is provided an electric connector in which connecting terminals inserted into a connector housing are respectively secured double not only by securing lances but also by retainers to be inserted through their associated retainer insertion holes formed in the connector housing, and also in which the retainers are held in their respective preset conditions within retainer insertion holes connecting the outside portion of the connector housing with terminal storage chambers respectively formed in the connector housing, and the retainers are inserted from the preset positions into their associated terminal storage chambers to be thereby secured to their associated connecting terminals stored within their respective terminal storage chambers, characterized in that, at the preset positions of the retainers that are respectively situated between the front end portions of the retainers formed in the insertion direction of the retainers and the rear end portions thereof, there are formed hook portions which can be respectively secured by the rear edge portions of the retainer insertion holes that are situated in the opposite direction to the connecting terminals insertion direction.

Also, according to a second aspect of the invention, there is provided an electric connector in which at least one terminal storage chamber is formed in a connector housing, at least one retainer is formed integrally with the connector housing through a band hinge in such a manner as to correspond to the terminal storage chamber, and while the retainer is held in a provisionally connected condition, after a terminal metal member is inserted into the terminal storage chamber and is thereby secured to a flexible securing piece, the terminal metal member is pressed and fixed by the retainer to thereby bring the terminal metal member into a fully connected condition, characterized in that, in the connector housing, there is formed an opening which communicates with the terminal storage chamber and also through which the retainer is inserted and secured to thereby bring the terminal metal member into a pressed and fixed condition; in the wall surface of the opening, there is provided a rib which is capable of bringing the retainer into the provisionally connected condition; in the rib, there is formed a cut-away portion which secures the retainer to the opening to thereby achieve a fully connected condition; and, in the retainer, there are provided a first projection which is able to move beyond the rib due to pressure applied thereto in the direction of the terminal storage chamber, and a second projection which can hold said rib by and between the first projection and itself and also which allows the cut-away portion to pass therethrough to thereby achieve the fully connected condition.

According to a third aspect of the invention, in the electric connector as defined in the second aspect of the invention, the rib includes two parallel surfaces respectively intersecting at right angles to the insertion direction of the retainer into the terminal storage chamber in which the retainer is brought into the provisionally connected condition, the first projection includes a tapered surface for facilitating the movement thereof beyond the rib and an opposing surface formed in such a manner as to be parallel opposed to the rib in the provisionally connected condition, and the second projection includes an opposing surface formed in such a manner as to be parallel opposed to the rib in the provisionally connected condition.

According to a fourth aspect of the invention, in the electric connector as defined in the second or third aspect of the invention, at least two of the retainers are connected integrally with each other to thereby form a connected retainer and, on the opposing side or on the opposite side of at least two retainers of the present connected retainer, there are provided the above-mentioned first and second projections.

According to a fifth aspect of the invention, in the electric connector as defined in the second or third aspect of the invention, in the rib, there is formed a provisional connection holding portion which can be engaged with the terminal metal member insertion-direction leading end of the first projection to thereby maintain the provisionally connected condition.

DETAILED DESCRIPTION OF THE PREFERRED EMBODIMENTS

Now, description will be given in more detail of embodiments of the invention with reference to accompanying drawings.

The electric connector according to an embodiment of the present embodiment is characterized by its retainer structure and the remaining portions of the present embodiment are similar in structure to those of the above-mentioned conventional electric connector. However, a description will be given hereinbelow of the whole structure of the present electric connector.

Figure 1:
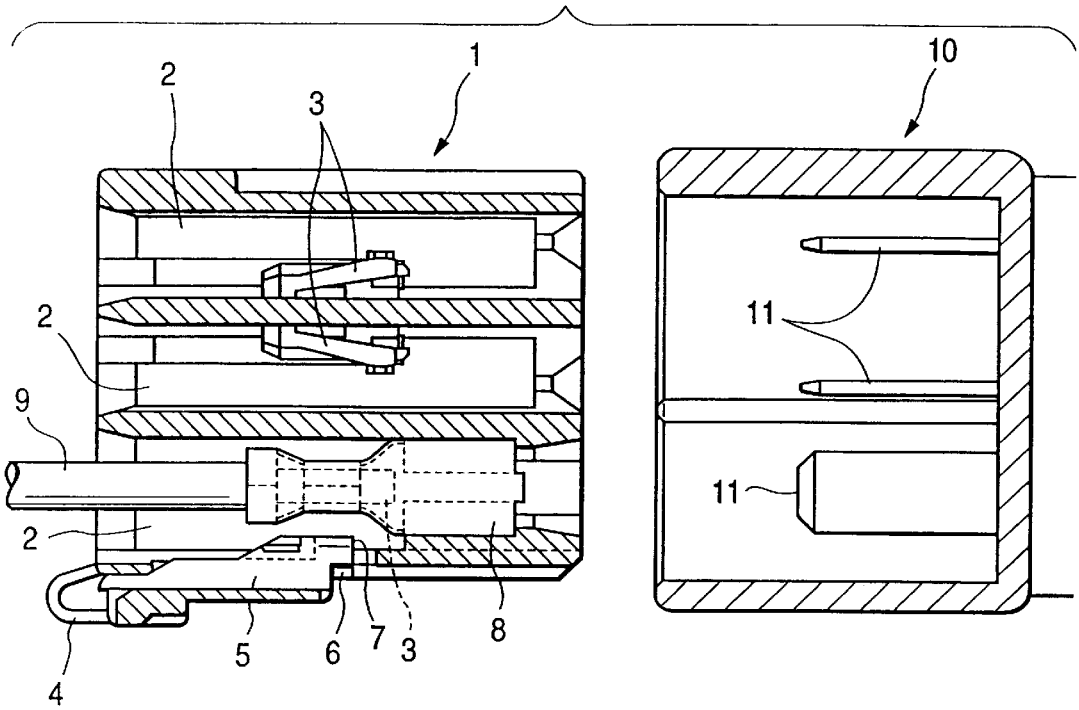
FIG. 1 PRIOR ART
FIG. 1 is a section view of a conventional electric connector and a check connector.
Figure 2:
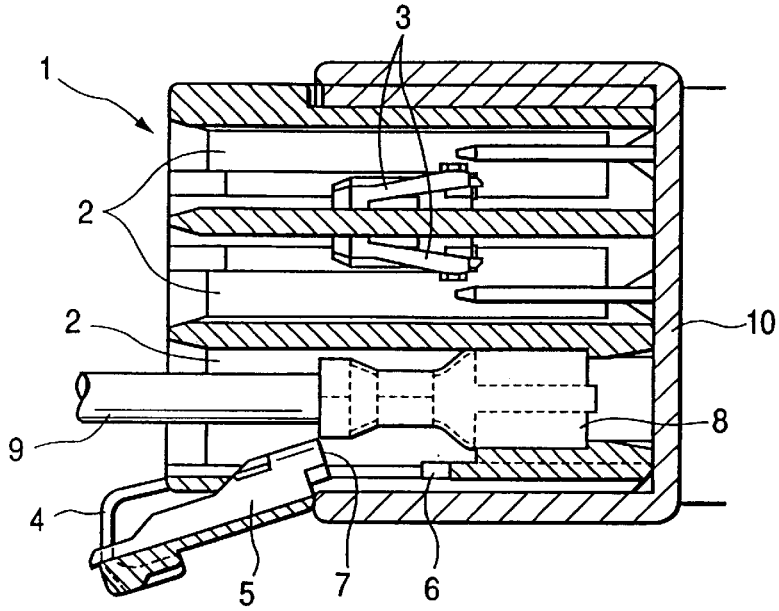
FIG. 2 PRIOR ART
FIG. 2 is a section view showing the conventional electric connector in a state where it is engaged with the check connector.
Figure 3:
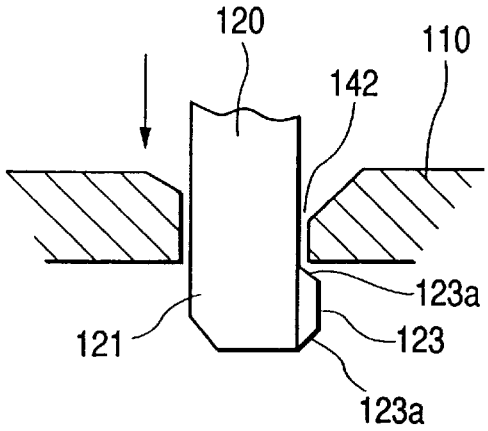
FIG. 3 PRIOR ART
FIG. 3 is an enlarged view of the main portions of a conventional electric connector.
Figure 4:
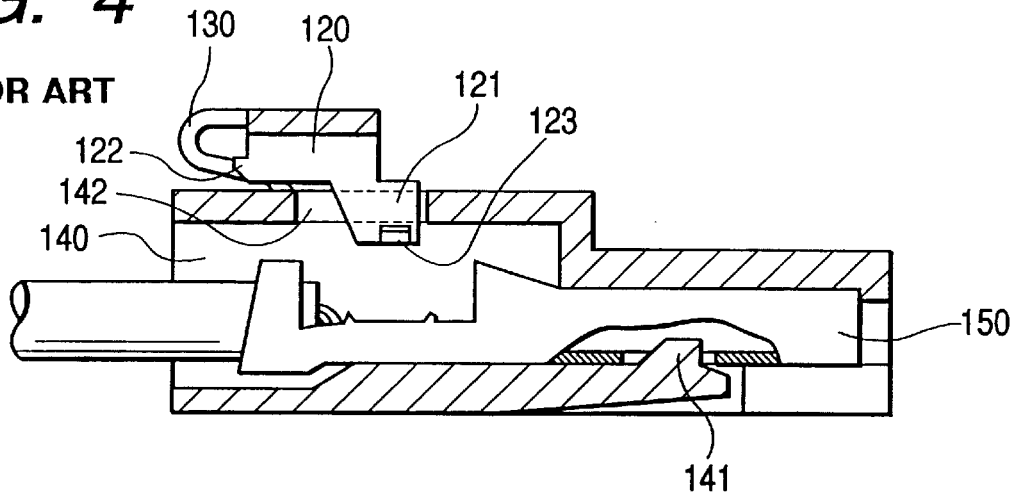
FIG. 4 PRIOR ART
FIG. 4 is an explanatory view of the main portions of the conventional electric connector, showing the provisionally connected condition thereof after a terminal metal member is inserted.
Figure 5:
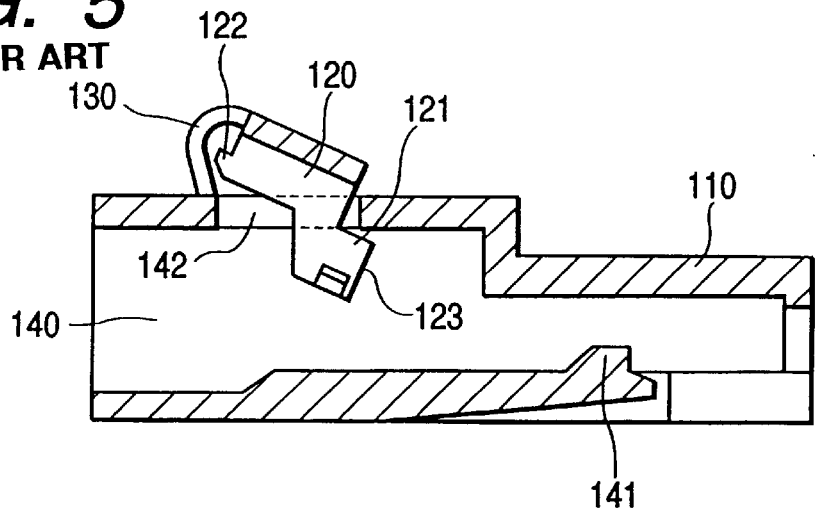
FIG. 5 PRIOR ART
FIG. 5 is an explanatory view of a state of the conventional electric connector in which a retainer is inserted from the provisionally connected condition into a terminal storage chamber.
Figure 6:
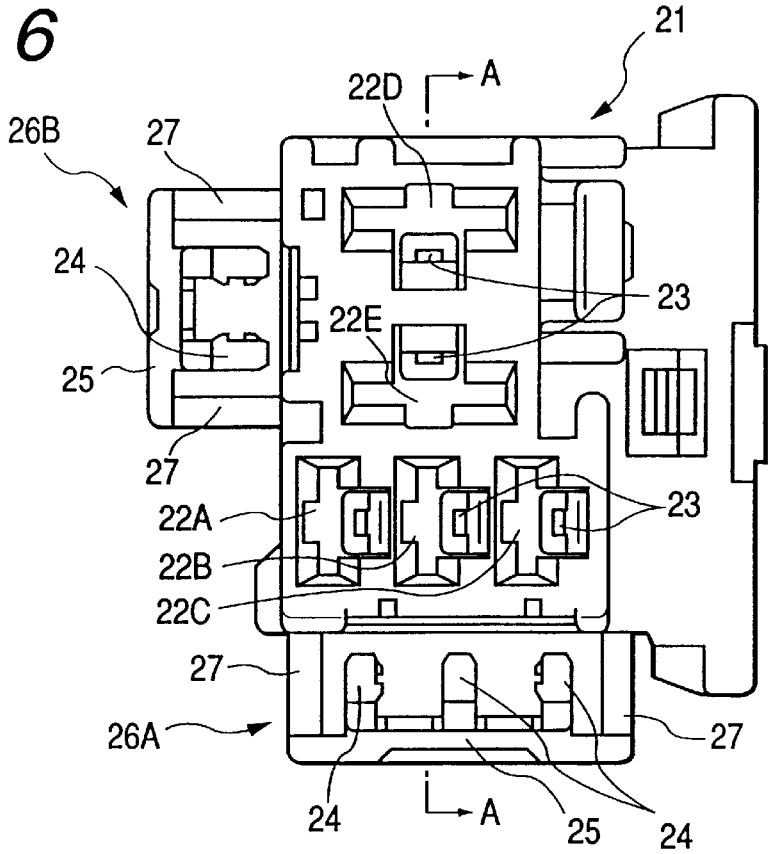
FIG. 6 is a front view showing an electric connector according to an embodiment of the invention.
Figure 7:
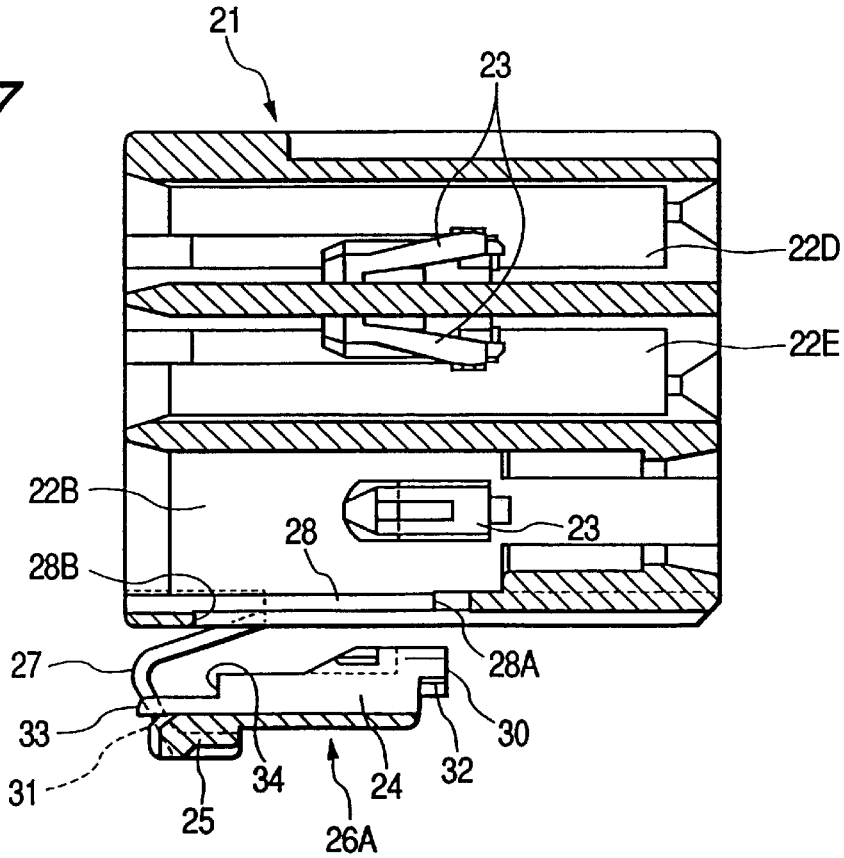
FIG. 7 is a section view taken along the line A—A shown in FIG. 6.

In FIGS. 6 to 10B, reference character 21 designates a connector housing which is formed of resin. In the connector housing 21, as shown in FIG. 6, there are formed a total of five terminal storage chambers 22A, 22B, 22C, 22D and 22E; in particular, those three terminal storage chambers 22A, 22B, 22C are arranged in a horizontal line, whereas the remaining two terminal storage chambers 22D and 22E are arranged in a vertical line. In the respective terminal storage chambers, their associated securing lances 23 are formed integrally with the connector housing 21. The securing lances 23 are all the same in shape and they are similar in shape to the conventional securing lances and, therefore, the detailed description thereof the securing lances 23 is omitted here.

Reference character 24 designates retainers which are respectively to be inserted into their associated terminal storage chambers. These retainers 24 are divided into blocks through connecting portions 25. In particular, the retainers 24 that are respectively to be inserted into the terminal storage chambers 22A, 22B and 22C are formed in a first block 26A, whereas the retainers 24 that are respectively to be inserted into the terminal storage chambers 22D and 22E are formed in a second block 26B; and, the retainer blocks 26A and 26B are respectively connected to and held by the connector housing 21 through their associated flexible bands 27 which are respectively provided from the outer side surface of the connector housing 21.

Also, the retainers 24 can be inserted through their associated retainer insertion holes 28, which are respectively formed in the side wall of the connector housing 21 in such a manner as to extend therethrough, and can be then inserted into their associated terminal storage chambers from the outside portion of the connector housing 21, so that they can be secured to their associated connecting terminals to be discussed later. The retainers 24 are identical in shape with one another and, therefore, description will be given here of the shape and structure of one of the retainers 24.

That is, the retainer 24 includes a front end portion 30 facing in the insertion direction of connecting terminals 29 to be inserted into their associated terminal storage chambers 22A–22E, and a rear end portion 31 which is situated at the opposite position to the front end portion 30. In the front end portion 30, there is formed a securing stepped portion 32 to be secured to the front edge portion of the retainer insertion hole 28 (the side edge portion of the retainer insertion hole 28 that is situated in the connecting terminal insertion direction) and, in the rear end portion 31 of the retainer 24, there is formed a securing pawl piece 33 to be secured to the rear edge portion 28B of the retainer insertion hole 28 (the opposite side edge portion to the front edge portion 28A). Further, at the position of the retainer 24 that is situated between the front and rear end portions 30 and 31 and is rather near to the rear end portion 31, there is formed a hook portion 34 which can be engaged with the rear edge portion 28B of the retainer insertion hole 28.

This embodiment is especially characterized by the above-mentioned structure of the retainer 24, and therefore, a description will be given of the operation of the retainer 24 thus structured.

When the connector housing 21 is made of resin, the above-structured retainer 24 is connected to the connector housing 21 through its associated flexible band 27 and is formed integrally with the connector housing 21. However, because the retainer 24 is connected to the connector housing 21 only by the flexible band 27, for example, when the connector housing 21 is delivered (transported), there is a fear that the retainer 24 swings loosely or is caught by other things so that the flexible band 27 is cut. In order to eliminate such fear, the retainer 24 is held in a preset condition within the connector housing 21.

Figure 8:
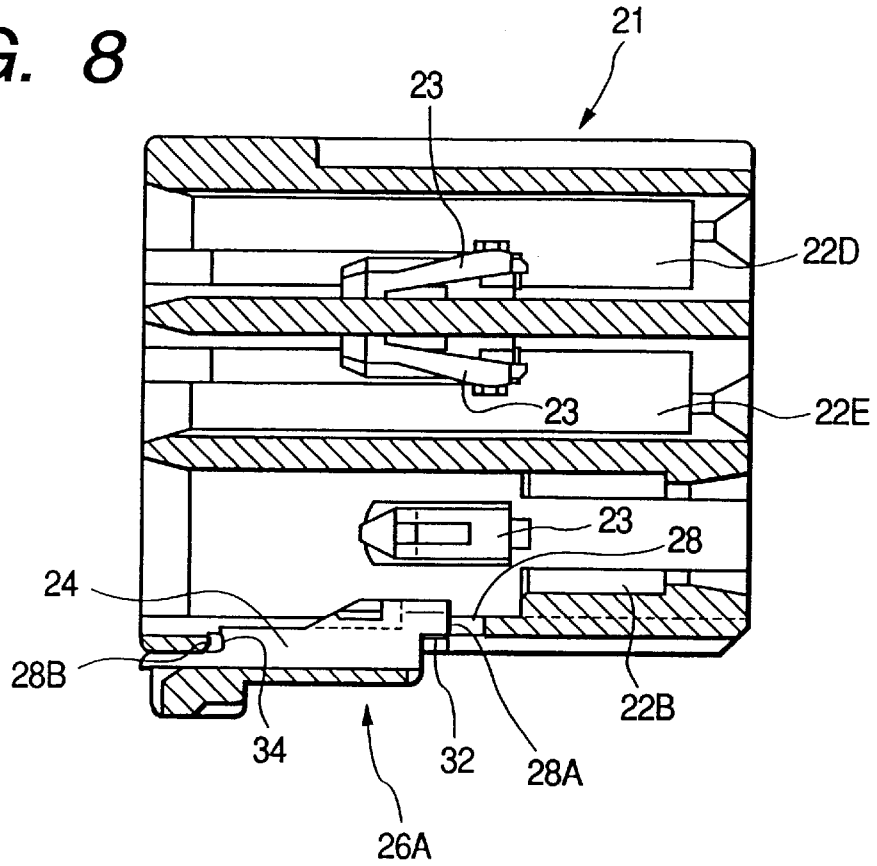
FIG. 8 is a section view of the electric connector according to the embodiment of the invention, showing the preset condition of a retainer employed therein.

To preset the retainer 24 with respect to the connector housing 21, as shown in FIG. 8, the securing stepped portion 32 of the retainer 24 may be engaged with the front edge portion 28A of the retainer insertion hole 28, and at the same time, the hook portion 34 of the retainer 24 may be engaged with the rear edge portion 28B of the retainer insertion hole 28, so that the retainer 24 is preset in the connector housing 21.

Then, with respect to the connector housing 21 with the retainers 24 preset therein, to insert the connecting terminals 29 into their respective terminal storage chambers 22A–22E in the next step, the connecting terminals 29 may be respectively inserted into the terminal storage chambers 22A–22E from the openings thereof which are formed in the rear end portions thereof. In such connecting terminal inserting operation, since the retainers 24 are respectively held in their preset conditions, the connecting terminals 29 can be inserted into their respective terminal storage chambers 22A–22E with no trouble until they are secured by their respective securing lances 23.

Figure 9:
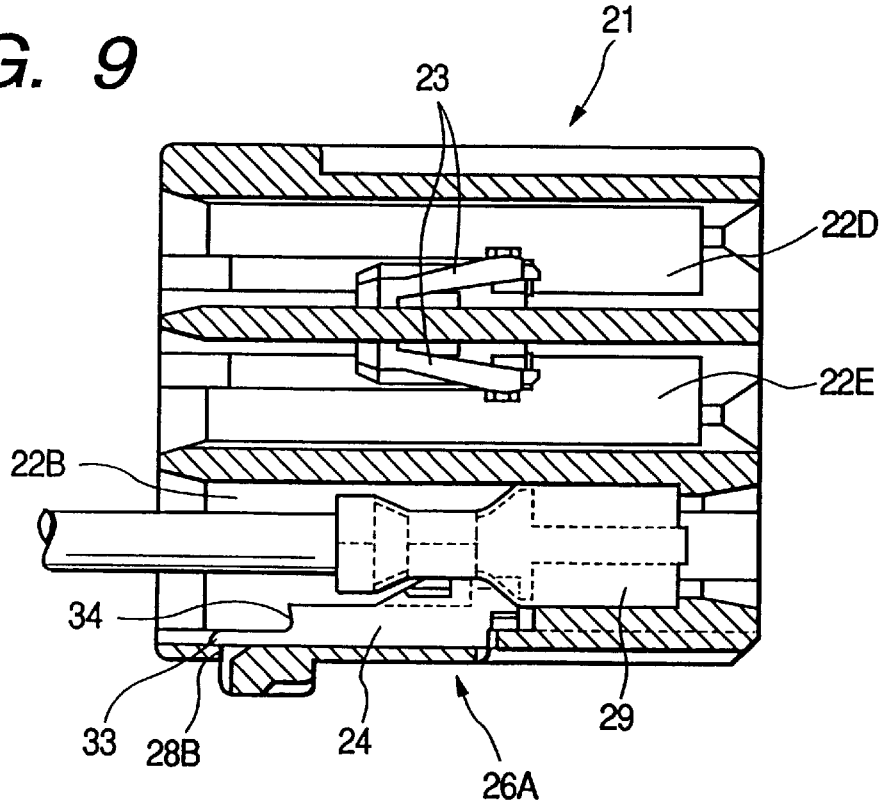
FIG. 9 is a section view of an electric connector according to the embodiment of the invention, showing the set condition of a retainer employed therein.
Figure 10A:
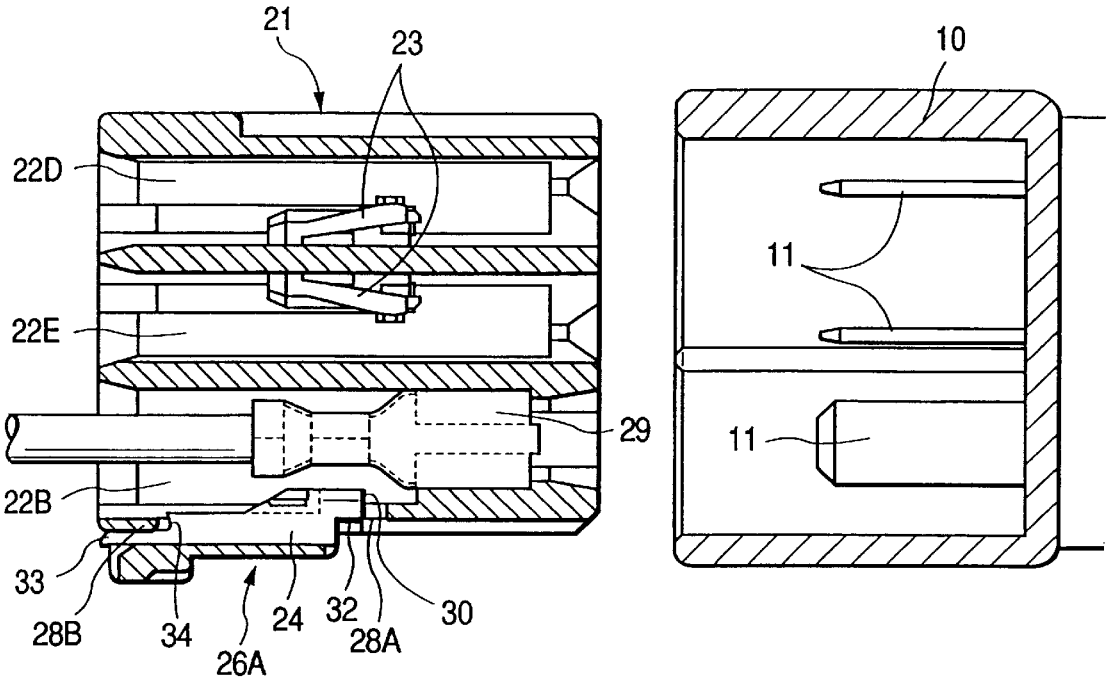
FIGS. 10A and 10B are respectively section views of the electric connector according to the embodiment of the invention, showing the engaging operation of a check connector to be executed therein.
Figure 10B:
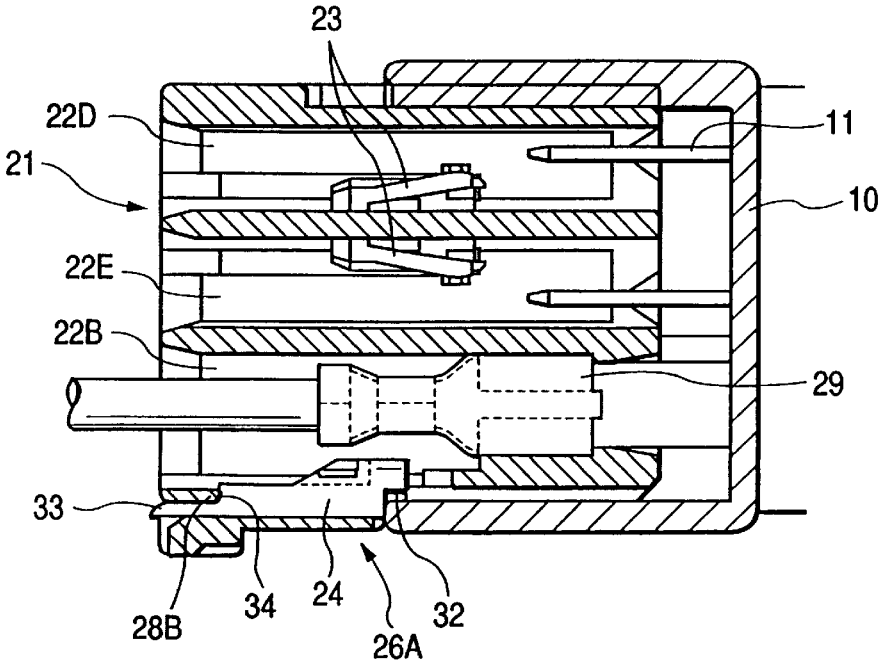

The retainers 24 thus preset are then inserted into the connector housing 21 through their respective retainer insertion holes 28 and the retainers 24 are secured to the connecting terminals 29. In this retainers 24 inserting operation, as shown in FIG. 9, if the front end portions 30 of the retainers 24 are contacted with the shoulders of the connecting terminals 29 and further the securing pawl pieces 33 of the retainers 24 are secured to the inside portions of the rear edge portions 28B of the retainer insertion holes 28, the setting of the retainers 24 at their respective proper positions is then completed; that is, the connecting terminals 29 are respectively secured double not only by their associated securing lances 23 but also by their associated retainers 24 within their associated terminal storage chambers.

After the connecting terminals are respectively inserted into the connector housing 21 in this manner, the check connector 10 (see FIGS. 10A and 10B), which has been previously discussed in the conventional electric connector, is fitted or engaged with the connector housing 21 to conduct a test as to whether the connecting terminals are inserted correctly at their respective proper positions, or not. If the retainers 24 are forgotten to be set and thus they are still left in their preset conditions, that is, if there occurs a state in which the connecting terminals are not secured by their respective retainers 24, then the check connector 10 cannot be engaged with the connector housing 21 completely, thereby being able to detect the fact that the retainers 24 are not set.

In other words, if the retainers 24 remain preset, then the hook portions 34 formed in such retainers 24 remain secured to the rear edge portions 28B of the retainer insertion holes 28 so that such retainers 24 are prevented from moving back with respect to the connecting housing 21. For this reason, the check connector 10 to be engaged with the connector housing 21 is interfered by such retainers 24 and thus they cannot be engaged with the connector housing 21 completely, which makes it possible to detect that the retainers 24 are still left in their preset conditions.

Therefore, according to the present embodiment, when the securing forces of the retainers 24 are not applied to the connecting terminals 29, that is, when the connecting terminals 29 are secured in a poor securing condition in which the connecting terminals 29 to be secured double are secured only by the securing lances 23 but the securing forces of the retainers 24 are not applied to the connecting terminals 29, it is possible to detect such poorly secured condition of the connecting terminals easily and positively when the check connector 10 is operated for its engagement with the connector housing 21.

FIGS. 11 to 20 show an electric connector according to another embodiment of the invention. In this embodiment, parts identical with or equivalent to those employed in the above mentioned conventional electric connector, are given the same designations and the duplicate description thereof is omitted here.

A connector housing 110 includes at least one terminal storage chamber 140. In an electric connector shown in FIGS. 11 to 20, the connector housing 110 includes five terminal storage chambers 140 into which their respective terminal metal members 150 are inserted; and in particular, three terminal storage chambers 140 are arranged horizontally in a lower stage, whereas the remaining two terminal storage chambers 140 are arranged vertically in an upper stage.

Correspondingly to the terminal storage chambers 140, retainers 160 are formed integrally with the connector housing 110 through band hinges 130. Referring to the manner of connecting the retainers 160, the retainers 160 may be individually connected direct to the connector housing 110 through their respective band hinges 130. Alternatively, two or more retainers 160 may be collected together to thereby form a connected retainer 170, and after then, the connected retainer 170 may be connected to the connector housing 110. In the illustrated embodiment, at least two retainers 160 are connected together into a connected retainer 170: that is, in the lower portion of the connector housing 110, three retainers 160 are integrally connected together to form a connected retainer 170; and, in the side portion of the connector housing 110, two retainers 160 are integrally connected together to form a connected retainer 170.

Figure 17:
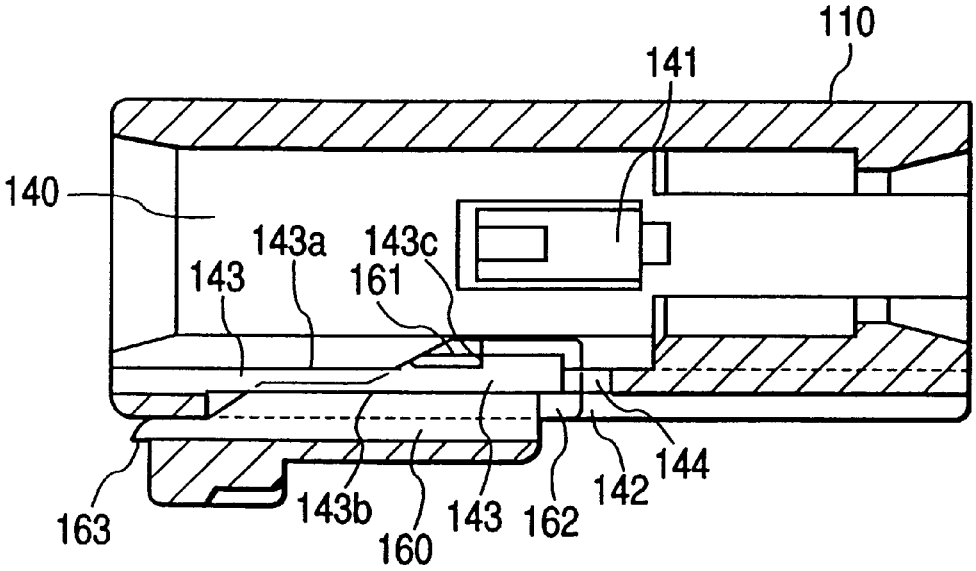
FIG. 17 is an explanatory view of the terminal storage chamber portion of the electric connector shown in FIG. 16, showing the provisionally connected condition thereof.

In the connector housing 110, there is formed an opening 142 which communicates with the terminal storage chambers 140 and through which the retainer 160 can be inserted and secured to the terminal metal member 150 to thereby put the terminal metal member 150 into a pressed and fixed condition. In the opening 142, there is provided a rib 143 which is used to put the retainer 160 into such a provisionally connected condition as shown in FIG. 17. The rib 143 includes two parallel surfaces 143*a* and 143*b* which respectively intersect at right angles to the insertion direction of the retainer 160 into the terminal storage chamber 140 where the retainer 160 can be put into the provisionally connected condition; and, the rib 143 has a rectangular-shaped cross section including corner portions. Also, in the rib 143, there is formed a cut-away portion 144 which is capable of shifting the retainer 160 from the provisionally connected condition to the fully connected condition.

On the other hand, the retainer 160 includes a first projection 161 which can move beyond the rib 143 due to pressure applied thereto in the direction of the terminal storage chamber 140, and a second projection 162 which can put the rib 143 into the provisionally connected condition shown in FIG. 17 where the rib 143 is situated loosely between the first projection 161 and itself and also which allows the cut-away portion 144 to pass therethrough to thereby put the rib 143 into such fully connected condition as shown in FIG. 17. The second projection 162 is formed in such a manner that it is shifted from the first projection 161 in a direction intersecting at right angles to the retainer inserting direction. The width of the opening 142, through which the retainer 160 portion including the first projection 161 is made to pass, is set slightly smaller than the thickness of the present retainer 160 portion. Therefore, if the retainer 160 is forcibly inserted once, then the retainer 160 is prevented against removal.

Figure 20:
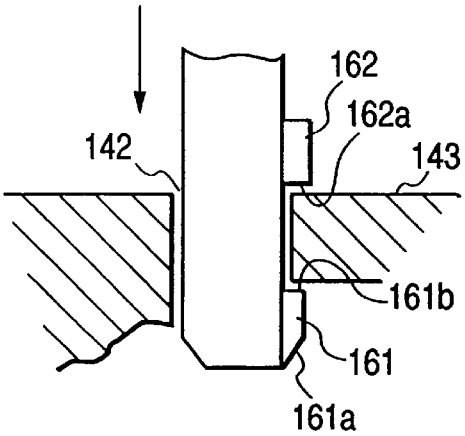
FIG. 20 is an enlarged view of the main portions of the electric connector according to the embodiment of the invention.

The engagement relation between the leading end portion of the retainer 160 and the rib 143 of the opening 142 is shown typically and enlargedly in FIG. 20. In the first projection 161, there are formed a tapered surface 161*a* which facilitates of the movement of the first projection 161 when it goes beyond the rib 143, and an opposing surface 161*b* which is opposed to the rib 143 in parallel in the provisionally connected condition. Also, in the second projection 162, there is formed an opposing surface 162*a* which is parallel opposed to the rib 143 in the provisionally connected condition.

Figure 11:
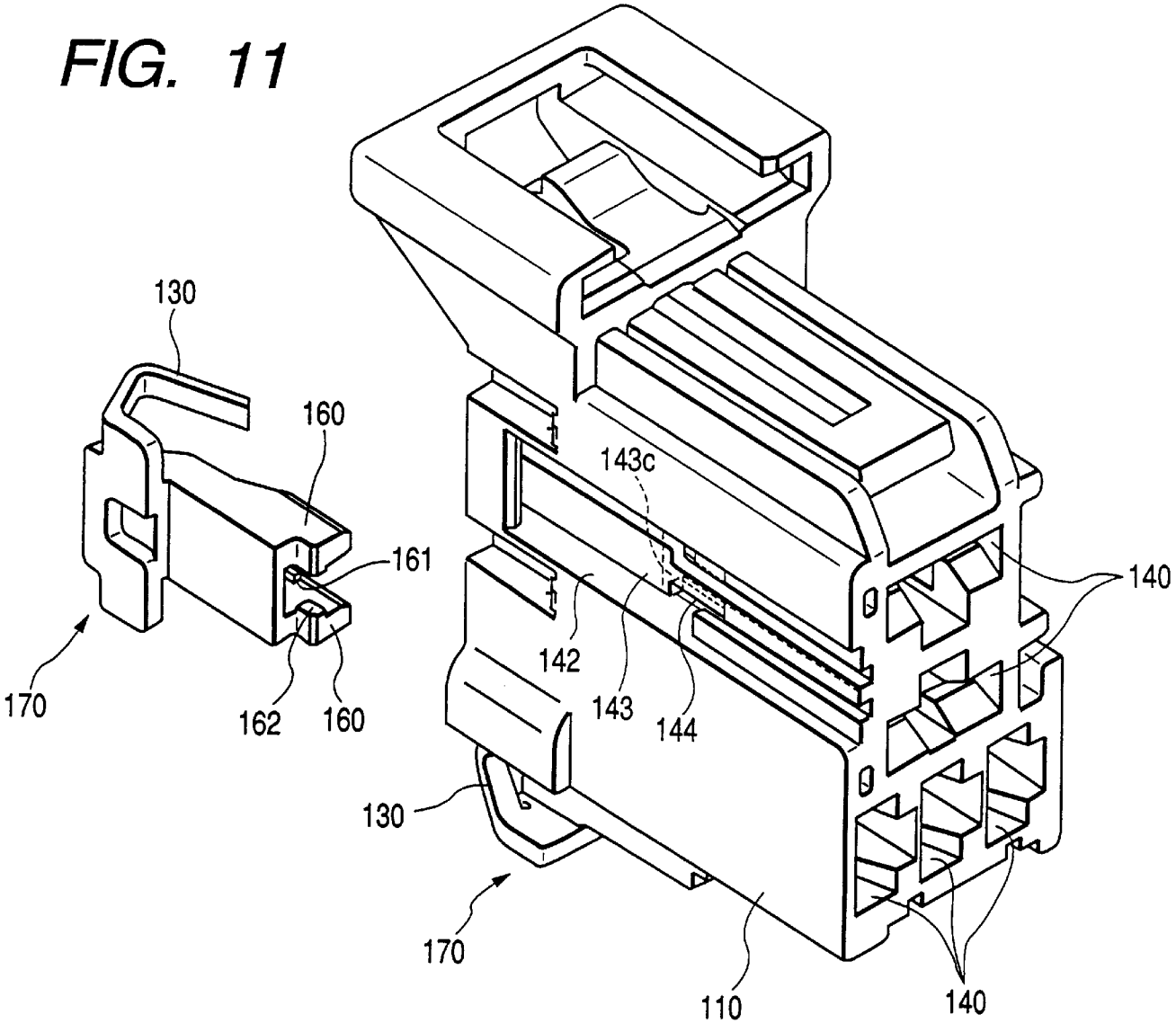
FIG. 11 is a perspective view of the whole of an electric connector according to another embodiment of the invention, with part thereof separated from the electric connector.
Figure 12:
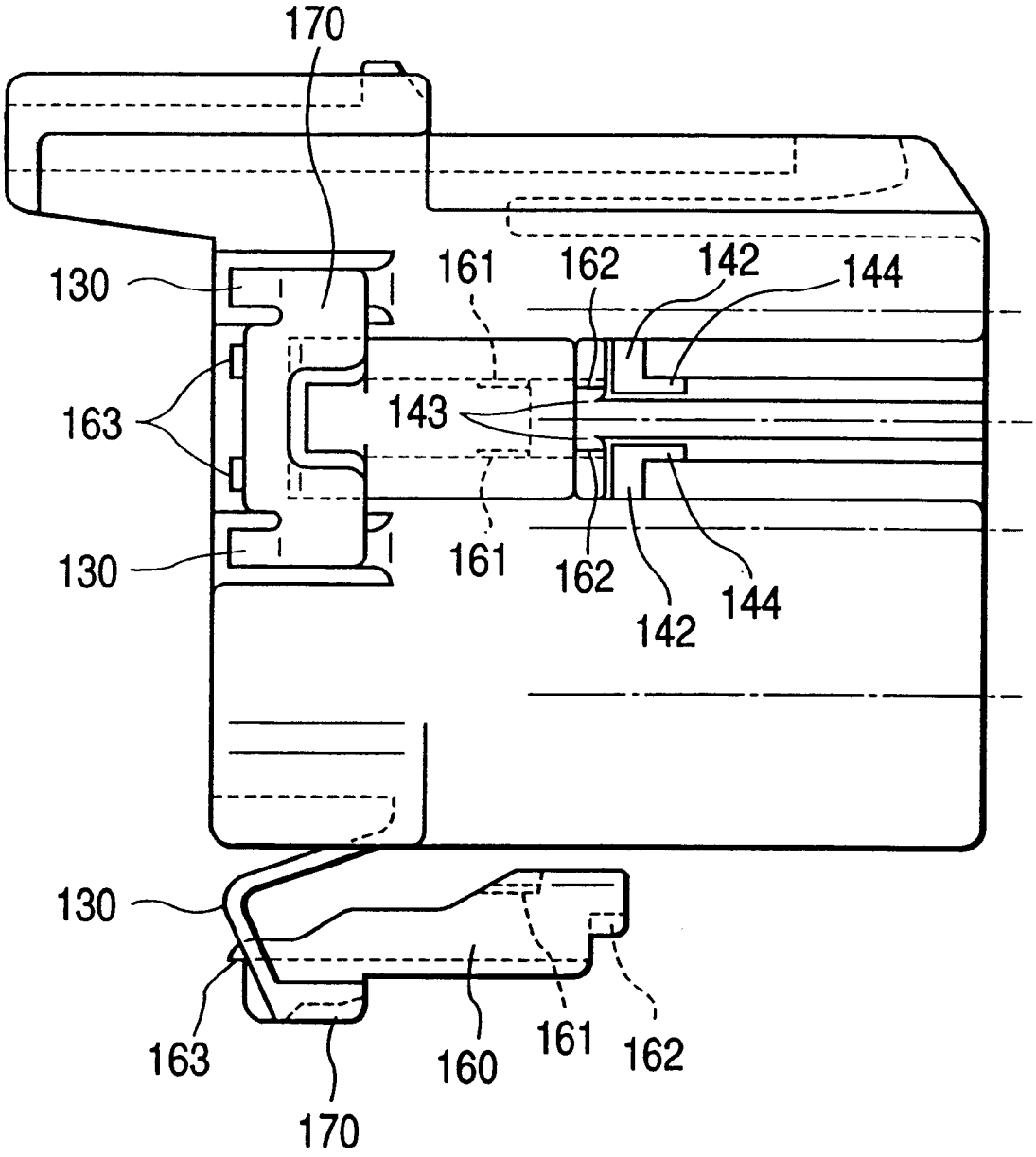
FIG. 12 is a front view of the electric connector shown in FIG. 11.

By the way, as can be obviously seen from FIGS. 11 and 12, the opening 142 has a substantially long rectangular shape; and, the opening 142 is composed of a portion which receives the longitudinal direction of the retainer 160 along the rib 143, and a portion which is widened by the cut-away portion 144. In the longitudinal-direction front and rear ends of the opening 142, there can be secured the leading end portion the second projection 162 where the second projection 162 is held in the fully connected condition and the rear end securing portions 163 of the second projection 162, respectively.

Figure 13:
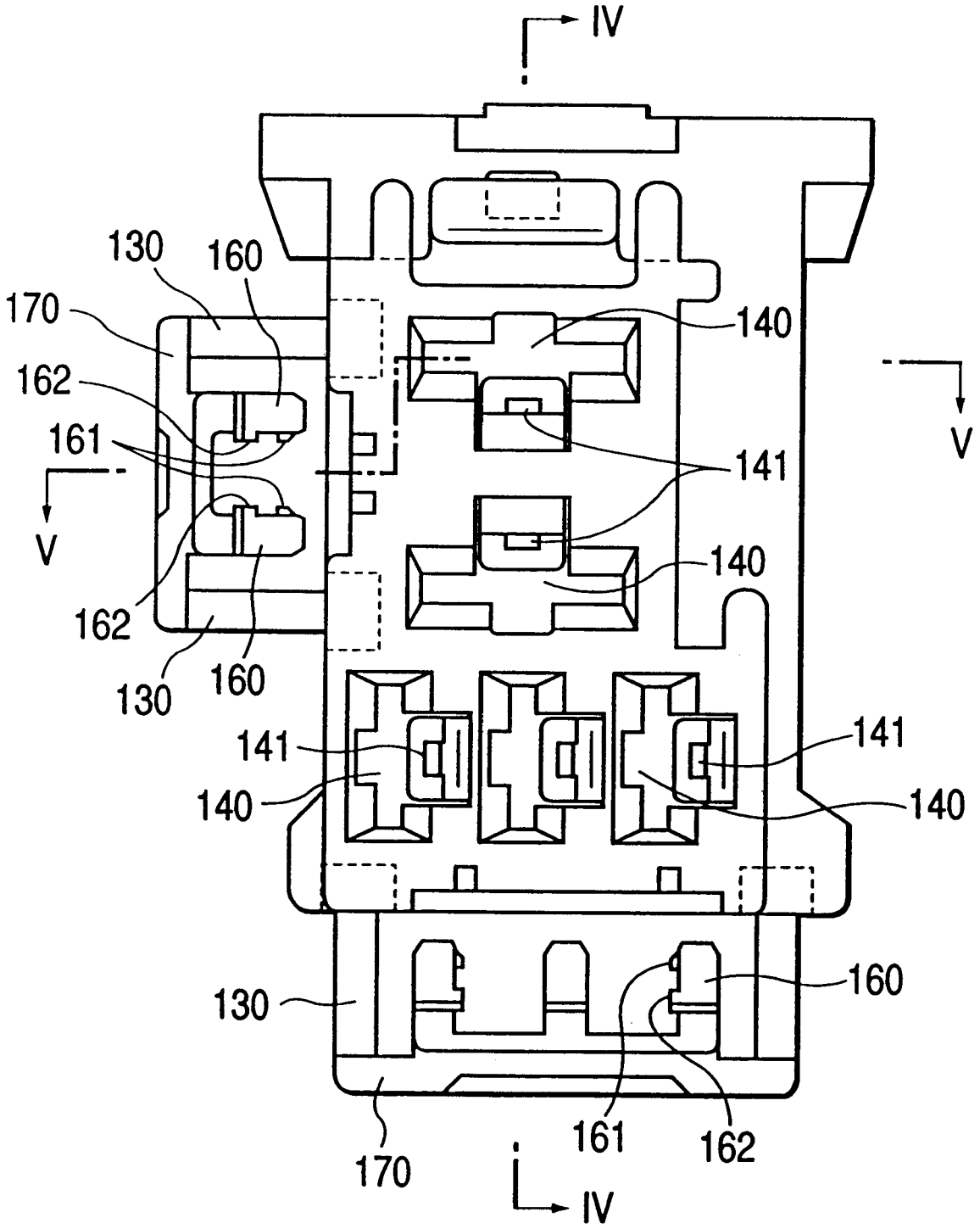
FIG. 13 is a right side view of the electric connector shown in FIG. 11.
Figure 14:
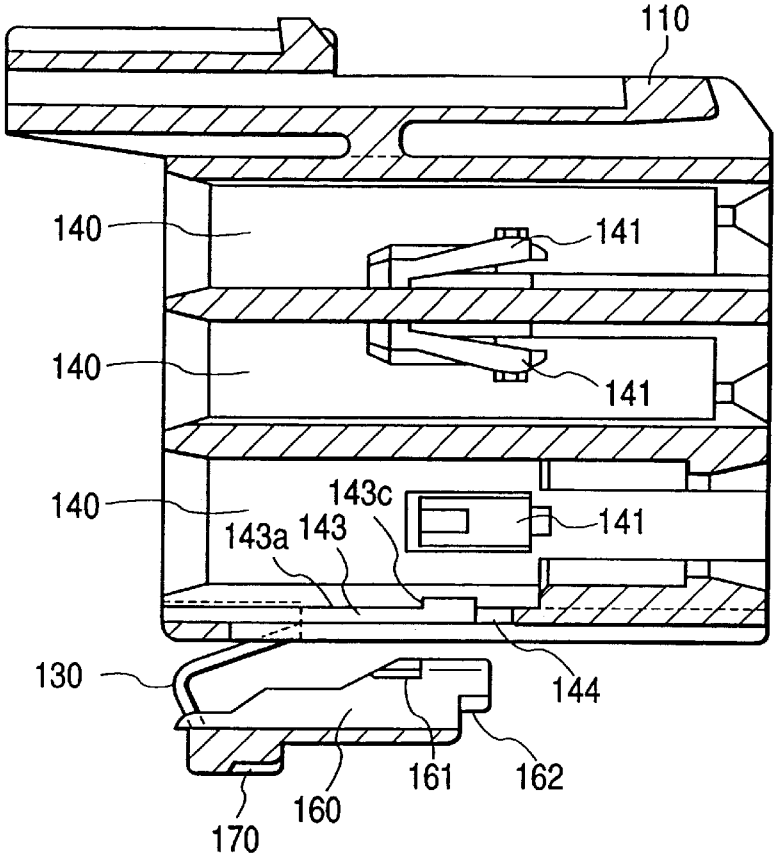
FIG. 14 is a section view taken along the line IV—IV shown in FIG. 13.
Figure 15:
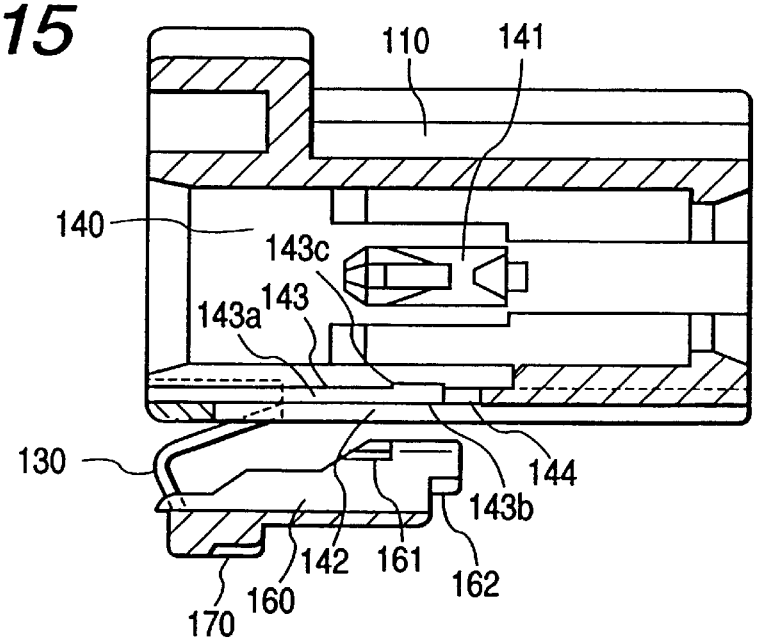
FIG. 15 is a section view taken along the line V—V shown in FIG. 13.

Also, as shown in FIG. 13, the connected retainer 170 is composed of at least two retainers 160 which are connected together in an integral manner; and, the first and second projections 161 and 162 are formed not on the same direction side of at least two retainers 160 but on the opposing side thereof or on the opposite side thereof.

Further, as shown in FIGS. 14 to 19, the rib 143 includes a provisional connection holding portion 143*c* which can be engaged with the leading end of the first projection 161 in the insertion direction of the terminal metal member 150 to thereby maintain the provisionally connected condition shown in FIG. 17. Here, the provisional connection holding portion 143*c* consists of a stepped portion which projects from the parallel surface 143*a* of the rib 143 into the terminal storage chamber 140. However, the provisional connection holding portion 143*c* may also be formed of a wall, a projection or the like, provided that it can prevent the retainers 160 or 170 from being removed from the provisionally connected condition easily, that is, provided that it can keep the provisionally connected condition. The height of the stepped portion or the provisional connection holding portion 143*c* is set less than or equal to the value that is obtained by subtracting the thickness of the rib 143 from the distance between the first and second projections 161 and 162.

Subsequently, a description will be given of a method for pressing and fixing the terminal metal member 150 with reference to FIGS. 16 to 19.

Figure 16:
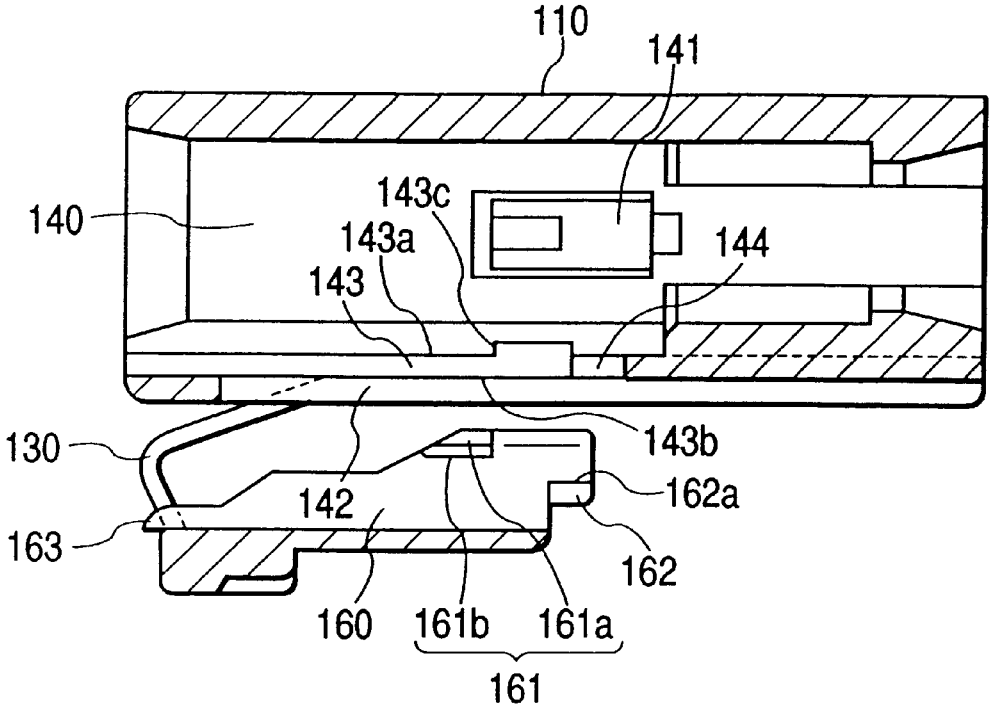
FIG. 16 is an explanatory view of the electric connector according to the embodiment of the invention, showing a state of one of terminal storage chambers formed in the electric connector after the electric connector is molded.

An electric connector shown in FIG. 16 is a resin product in which the retainers 160 and connected retainers 170 are formed by injection molding integrally with the connector housing 110 through the band hinges 130. If such electric connectors are piled up on top of another and moved together in the illustrated state, then there is a fear that the electric connector is entwined with other electric connector (s) in the narrow and soft band hinge 130 portion thereof.

To avoid such fear, if the connected retainer 170 is pushed from the state shown in FIG. 16 in the direction of the terminal storage chamber 140, then the first projection 161 of the retainer 160 is allowed to move beyond the rib 143 of the opening easily but with sufficient resistance due to the tapered surface 161*a* thereof, so that the first projection 161 can hold the rib 143 by and between the second projection 162 and itself; that is, as shown in FIG. 17, there is obtained a provisionally connected condition in which the terminal metal member 150 can be inserted into the terminal storage chamber 140 at any time. Because the rib 143 has a rectangular cross section and the two parallel surfaces 143*a*, 143*b* thereof are respectively parallel opposed to the opposing surfaces 161*b*, 162*a*, and also because of the elasticity of the band hinge 130, there is no possibility that the connected retainer 160 or 170 is inserted further into the terminal storage chamber 140 when a little force is applied to the connected retainer 160 or 170. Also, even if the electric connectors are handled rather roughly in the above-mentioned provisionally connected condition, there is no fear that the electric connectors are entwined together. Further, since the first and second projections 161 and 162 are formed not on the same direction side of at least two retainers 160 but on the opposing side thereof or on the opposite side thereof, there is only a small room which allows the retainer 160 to move and there is only a low possibility that the retainer 160 is removed from the provisionally connected condition, thereby being able to hold the provisionally connected condition further positively (see FIGS. 12 and 13).

Since provision of the first and second projections 161 and 162 is able to maintain the provisionally connected condition positively, there is a low possibility that the retainers 160 can be removed from the provisionally connected condition. However, when the present electric connector is packed and delivered together with other electric connectors, there is the possibility that the present electric connector is pressed by the other electric connector(s) and thus the provisionally connected condition can be removed to thereby bring the retainers 160 into a half inserted condition. In order to avoid such possibility, the provisional connection holding portion 143*c* is formed in the rib 143.

Figure 18:
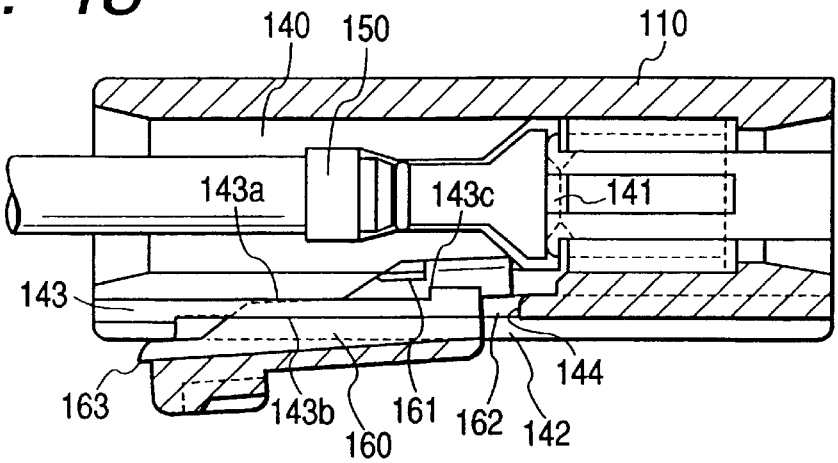
FIG. 18 is an explanatory view of a state of the terminal storage chamber portion of the electric connector shown in FIG. 16, showing a retainer inserting operation to be executed after a terminal metal member is inserted.
Figure 19:
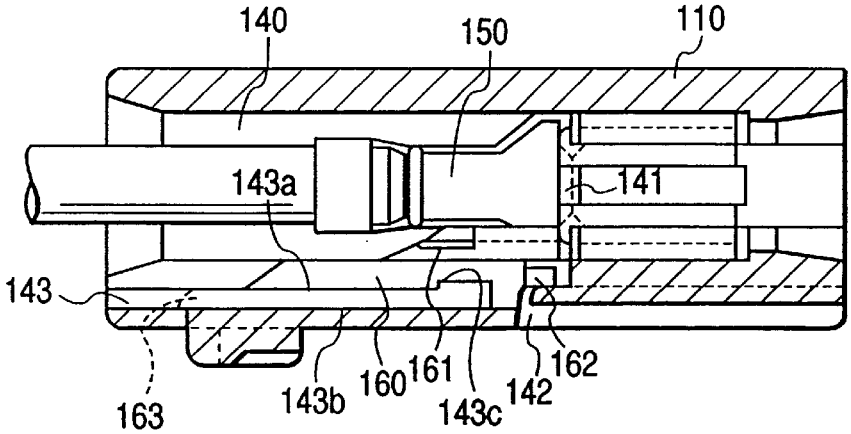
FIG. 19 is an explanatory view of the terminal storage chamber portion of the electric connector shown in FIG. 16, showing the fully connected condition thereof.

After then, in the state shown in FIG. 17, the terminal metal member 150 is inserted into the terminal storage portion 140 and is thereby secured to the flexible securing piece 141, so that the terminal metal member 150 is set at its given position. In this state, if the retainer 160 is pushed forward, then the second projection 162 is situated at the cutaway portion 144 of the rib 143; and if the retainer 160 is pushed further into the terminal storage chamber 140, then there can be obtained such a retainer inserting condition as shown in FIG. 18.

If the retainer 160 is still further pushed forward to thereby push the same into the terminal storage chamber 140, then, as shown, not only the retainer 160 presses against the terminal metal member 150 to thereby fix the same but also the longitudinal-direction front and rear ends of the opening 142 respectively receive the leading end portion of the retainer 160 where the second projection 162 is situated and the rear end securing portions 163 of the retainer 160, thereby completing a fully connected condition. Also, in the electric connector in which the provisional connection holding portion 143*c* is formed in the rib 143, if the retainer 160 is pushed in more deeply, then the engagement of the retainer 160 with respect to the provisional connection holding portion 143*c* is removed to thereby be able to bring the retainer 160 into the fully connected condition.

As has been described heretofore, according to the first aspect of the invention, it is possible to detect easily and positively the poorly secured condition of the connecting terminals in which the connecting terminals to be secured double within the connector housing using the securing lances and retainers are not secured double. This makes it possible to prevent the overlooking of an electric connector in which the connecting terminals are secured poorly within the connector housing.

Also, according to the second aspect of the invention, since the retainer is prevented from removing from the provisionally connected condition and also from advancing further into the terminal storage chamber in the provisionally connected condition, while handling the electric connectors, for example, while piling them up on top of another and moving them together, there is eliminated the possibilities that the electric connectors can be entwined together, the terminal metal members cannot be inserted, and the terminal metal members can be inserted in a wrong manner, thereby being able to carry out the terminal metal member assembling operation easily and positively.

According to the third aspect of the invention, not only the provisionally connected condition can be achieved with a small force but also the provisionally connected condition can be maintained positively.

According to the fourth aspect of the invention, when compared with a structure in which first and second projections are provided on the same direction, the retainer is difficult to remove from the provisionally connected condition, which makes it possible to maintain the provisionally connected condition more positively.

According to the fifth aspect of the invention, the retainer is more difficult to remove from the provisionally connected condition, which makes it possible to maintain the provisionally connected condition still more positively.

What is claimed is:

1. An electric connector, comprising:

a connector housing into which at least one connecting terminal is inserted, said connector housing having a retainer insertion hole;

a securing lance formed in said connector housing for securing said connecting terminal;

a retainer which is inserted in said retainer insertion hole for securing said connecting terminal;

a terminal storage chamber formed in said connector housing, said retainer being held at a preset position within the retainer insertion hole connecting an outside portion of said connector housing with said terminal storage chamber, said retainer being inserted from the preset position into said terminal storage chamber such that the connecting terminal stored within said terminal storage chamber is secured; and a hook secured by a rear edge of the retainer insertion hole for holding said retainer in the preset position, said hook disposed on said retainer in an opposite direction to said connecting terminal insertion direction, said hook situated between a front end portion and a rear end portion of said retainer, said front end portion formed in the insertion direction of said connecting terminal.

2. An electric connector, comprising:

a connector housing having at least one retainer insertion hole disposed thereon;

at least one terminal storage chamber formed in said connector housing;

a band hinge;

a flexible securing piece formed in said terminal storage chamber;

at least one retainer having a hook, said at least one retainer attached to said connector housing through said band hinge so as to correspond to said terminal storage chamber through said insertion hole, wherein said at least one retainer is held in a provisionally connected condition by said hook while a terminal metal member is inserted into said terminal storage chamber and said terminal metal member is secured to said flexible securing piece, said terminal metal member is pressed and fixed by said retainer into a fully connected condition;

a rib formed in the wall surface of said opening, said rib having a provisional connection holding portion which holds said retainer in the provisionally connected condition;

a first projection formed in said retainer, which is movable beyond said rib due to pressure applied thereto in the direction of said terminal storage chamber;

a second projection which holds said rib between said first projection and said second projection; and a cut-away portion formed in said rib for allowing said second projection to pass through said rib to achieve said fully connected condition.

3. An electric connector as set forth in claim 2, wherein said rib includes two parallel surfaces respectively intersecting at right angles to the insertion direction of said retainer into said terminal storage chamber in which said retainer is brought into said provisionally connected condition, said first projection includes a tapered surface for facilitating the movement thereof beyond said rib and an opposing surface formed in such a manner as to be parallel opposed to said rib in said provisionally connected condition, and said second projection includes an opposing surface formed in such a manner as to be parallel opposed to said rib in said provisionally connected condition.

4. An electric connector as set forth in claim 2, wherein at least two of said retainers are connected integrally with each other to thereby form a connected retainer and, on the opposite side of at least two retainers of said connected retainer, there are provided said first and second projections.

5. An electric connector as set forth in claim 2, wherein, in said rib, there is formed a provisional connection holding portion which can be engaged with the leading end of said first projection to thereby maintain said provisionally connected condition.

6. The electric connector according to claim 1 further comprising:

a check connector for checking conductivity of said connecting terminals, and wherein said retainer has an outer edge disposed such that, in the preset position, said outer edge protrudes outwardly from said connector housing thereby preventing said connector housing from being fully inserted into said check connector, and when said retainer is placed in a fully secured position, said retainer outer edge being substantially flush with said connector housing such that said connector housing can be fully into said check connector.

* * * * *